US006793487B2

(12) United States Patent
Hubbauer et al.

(10) Patent No.: US 6,793,487 B2
(45) Date of Patent: Sep. 21, 2004

(54) BINARY BURNER WITH VENTURI TUBE FUEL ATOMIZATION AND VENTURI JETS FOR THE ATOMIZATION OF LIQUID FUEL

(75) Inventors: Christian Hubbauer, Neuburg (DE); Bernd Mittmann, Germering (DE); Thomas Kerscher, Munich (DE); Christine Sallinger, Unterschleissheim (DE)

(73) Assignee: Webasto Thermosysteme International GmbH, Stockdorf (DE)

( * ) Notice: Subject to any disclaimer, the term of this patent is extended or adjusted under 35 U.S.C. 154(b) by 0 days.

(21) Appl. No.: 10/239,561

(22) PCT Filed: Mar. 23, 2001

(86) PCT No.: PCT/EP01/03358

§ 371 (c)(1),
(2), (4) Date: Jan. 15, 2003

(87) PCT Pub. No.: WO01/71251

PCT Pub. Date: Sep. 27, 2001

(65) Prior Publication Data

US 2003/0143506 A1 Jul. 31, 2003

(30) Foreign Application Priority Data

Mar. 24, 2000 (DE) ..... 100 14 405
Mar. 24, 2000 (DE) ..... 100 14 347

(51) Int. Cl.[7] ..... F23C 7/00

(52) U.S. Cl. ..... 431/353; 431/187; 431/8

(58) Field of Search ..... 431/8, 10, 351, 431/353 O, 187, 188; 239/499

(56) References Cited

U.S. PATENT DOCUMENTS

| | | | | |
|---|---|---|---|---|
| 2,857,961 A | * | 10/1958 | Brown | 431/116 |
| 4,004,875 A | * | 1/1977 | Zink et al. | 431/9 |
| 4,230,449 A | * | 10/1980 | Binasik et al. | 431/353 |
| 4,375,352 A | * | 3/1983 | Berry et al. | 431/8 |
| 4,396,372 A | | 8/1983 | Matumoto et al. | |
| 4,402,929 A | * | 9/1983 | Hunt | 423/456 |
| 5,220,786 A | | 6/1993 | Campbell | |

FOREIGN PATENT DOCUMENTS

| | | | |
|---|---|---|---|
| DE | 41 18 538 A1 | | 12/1992 |
| EP | 0 863 369 A2 | | 9/1998 |
| WO | WO 98/28493 | * | 7/1998 |

* cited by examiner

*Primary Examiner*—Alfred Basichas
(74) *Attorney, Agent, or Firm*—Nixon Peabody LLP; David S. Safran

(57) ABSTRACT

A burner, in particular, for a motor vehicle supplementary or parking heater, for the burning of liquid fuel, in the presence of combustion air, has a combustion chamber (10), with a jet for the atomization of liquid fuel, arranged before said chamber. The jet has a Venturi tube (11) at the largest diameter end of the diffuser section thereof, opening into the combustion chamber (10), and the liquid fuel is introduced into the Venturi region which is at a low pressure when compared with the upstream end of the diffuser section (12), and through the inlet section (13) of which the air is pumped.

19 Claims, 2 Drawing Sheets

BINARY BURNER WITH VENTURI TUBE FUEL ATOMIZATION AND VENTURI JETS FOR THE ATOMIZATION OF LIQUID FUEL

BACKGROUND OF THE INVENTION

1. Field of the Invention

The invention relates to a binary burner for an auxiliary motor vehicle heater, for combustion of liquid fuel in the presence of combustion air, with a combustion chamber which is downstream of a nozzle for atomization of liquid fuel, and a Venturi nozzle for atomization of liquid fuel.

2. Description of Related Art

German Patent DE 41 18 538 C2 discloses an example of a burner of the initially mentioned type. This burner is based on a dual-fuel nozzle for atomization of fuel which has a relatively complicated structure. In particular, this nozzle consists of an essentially cylindrical mixing chamber, a feed pipe coaxial to its lengthwise axis for the liquid fuel, and a combustion air medium feed. The mixing chamber of the nozzle is closed by a nozzle insert for discharge of the atomized fuel/combustion air mixture and has a central nozzle hole and a conical inner bevel which converges in the flow direction. The combustion air feed consists of a feed pipe which tangentially penetrates the mixing chamber wall, dips into it and discharges at a greater height above the nozzle insert than the feed pipe for the liquid fuel. Due to this complex structure of the dual-fuel nozzle, for its proper operation for atomization of the liquid fuel, a considerable air overpressure is required which must be applied by a correspondingly powerful fan.

In conjunction with the gas burners, use of Venturi tubes as a mixing means is known. Furthermore, U.S. Pat. No. 4,396,372 discloses a burner system in which liquid fuel in the form of kerosene is delivered by means of a nozzle to a vaporizer provided with electrical heating means, with a Venturi-shaped inlet area.

SUMMARY OF THE INVENTION

One object of this invention is to devise a burner or a Venturi nozzle for atomization of the liquid fuel which does not require a high air overpressure for atomization of the liquid fuel and which operates reliably.

This object is achieved by a burner with nozzle having a Venturi tube or a Venturi nozzle with an inlet part which tapers in the flow direction of the combustion air and with a diffuser part which widens in the flow direction of the combustion air, the larger diameter end of the diffuser part discharging the liquid fuel into the combustion chamber, in the underpressure area in the transition area from the inlet part to the diffuser part, and by a Venturi nozzle that is axially divided into a fuel/combustion air discharge part and a fuel/combustion air supply part, the two Venturi nozzle parts being heat insulated relative to one another.

Accordingly, in accordance with the invention, the complex nozzle used for the binary burner is replaced by an arrangement with a Venturi tube or a Venturi nozzle, which to prevent coking and heat losses is made at least partially of a ceramic material. As a result of the pressure recovery of the Venturi tube or the Venturi nozzle it is not necessary to deliver air with a high overpressure so that the strong fan or additional fan which had been necessary in the past for this purpose can be omitted. The Venturi tube (or Venturi nozzle) used in accordance with the invention, moreover, has the advantage that economical production is possible.

Both the installation cost as well as the production costs are advantageously reduced if at least the front section of the Venturi diffuser part or the Venturi nozzle is made integral with the combustion chamber.

In the simplest case, the diffuser part of the Venturi tube or Venturi nozzle is formed with a uniform opening angle. However, according to one advantageous development, this Venturi tube or Venturi nozzle diffuser part can have sections of different opening angles, the section with the greatest opening angle bordering the combustion chamber.

Advantageously, the fuel is supplied to the Venturi tube or Venturi nozzle via a fuel feed tube with downstream end projecting into the Venturi tube. This downstream end of the fuel feed tube can discharge into a downstream dual-fuel nozzle or into the underpressure area of a second smaller Venturi tube which is operated in turn by the pressure drop of the Venturi tube or Venturi nozzle and ends in its underpressure region in order to achieve pre-atomization. Furthermore, the fuel feed tube is advantageously located within the Venturi tube or Venturi nozzle running coaxially to its lengthwise center. The downstream end can be located at different locations of the Venturi tube or Venturi nozzle, for example, in the inlet part or in the diffuser part of the Venturi tube or the Venturi nozzle or at its narrowest site between the inlet part and diffuser part.

Furthermore, it is advantageously provided that the combustion chamber have at least one additional inlet for secondary air. This secondary combustion air inlet is preferably located in the plane of the combustion chamber in which the Venturi tube or Venturi nozzle discharges.

The invention is explained below by way of example using the drawings.

DETAILED DESCRIPTION OF THE INVENTION

Figure 1:
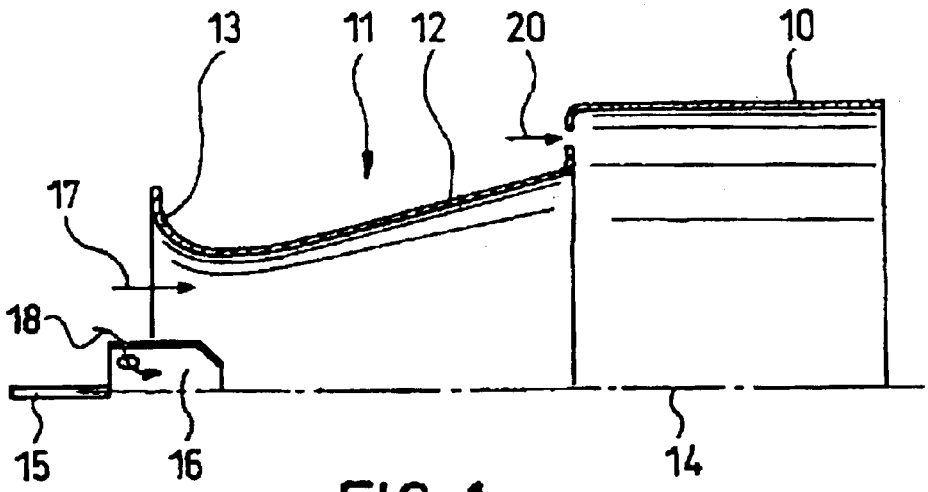
FIG. 1 schematically shows half of a lengthwise section of the combustion chamber and Venturi tube according to one embodiment of the dual-fuel burner.

The dual-fuel burner in accordance with the invention comprises a combustion chamber 10 of a preferably cylindrical or cuboidal shape. A Venturi tube 11 is connected to the fuel/combustion air inlet side of the combustion chamber 10. The Venturi tube 11 which forms the Venturi nozzle is formed preferably, at least in the connection area, integrally with the combustion chamber 10.

The Venturi tube 11, in the conventional manner, has a diffuser part 12 and an inlet part 13. The diffuser part 12 has a longer axial extension than the inlet part 13 and preferably has a conical shape, the end with the largest diameter of the conical diffuser part 12 being connected to the fuel/combustion air inlet of the combustion chamber 10. The inlet part 13 which, likewise, has a conical shape or at least one inlet radii with an optionally connected cylindrical part, with a section of greatest diameter pointing away from the combustion chamber 10, adjoins the end of the diffuser part 12 which is smallest in diameter.

The Venturi tube 11 and the combustion chamber 10 are preferably on a common lengthwise central axis 14. The fuel feed tube 15, with a dual-fuel nozzle 16 being connected to its downstream end, is flush with this lengthwise central axis. The outlet opening of the dual-fuel nozzle 16 lies at the narrowest point between the diffuser part 12 and the inlet part 13 of the Venturi tube 11, i.e., in an area at a lower pressure relative to the combustion chamber 10, as illustrated in FIG. 2.

Figure 3:
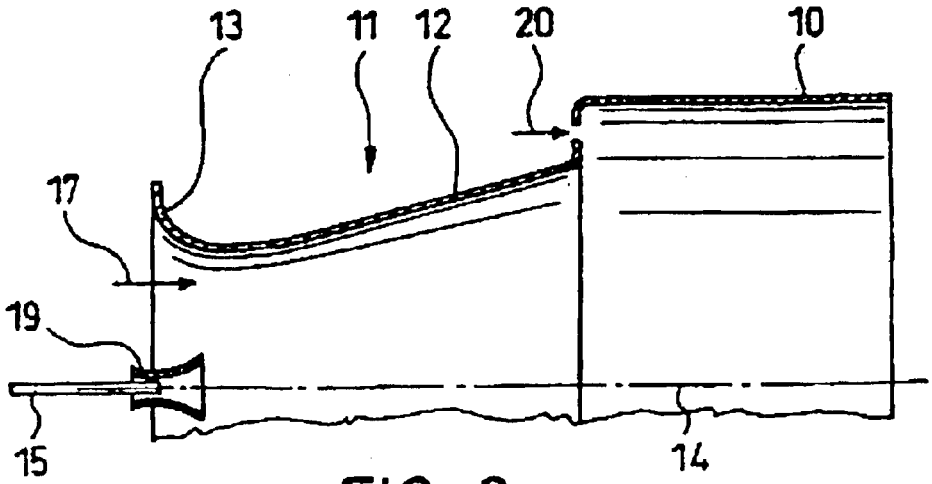
FIG. 3 shows one variant to FIG. 1 with a small Venturi tube instead of a nozzle for fuel atomization.

Instead of the dual-fuel nozzle 16, according to the version shown in FIG. 3, there can also be a small Venturi tube 19 at the same location which is operated by the pressure drop of the Venturi tube 11 and which ends in its underpressure area in order to achieve pre-atomization. In this case, the fuel feed tube 15 discharges in the smaller Venturi tube 19 by which air is likewise delivered.

Combustion air is fed into the inlet part 13 of the Venturi tube 11 by means of a fan (not shown) and which provides combustion air with only a small overpressure. The combustion air is delivered along the arrow 17 to the Venturi tube 11.

Figure 2:
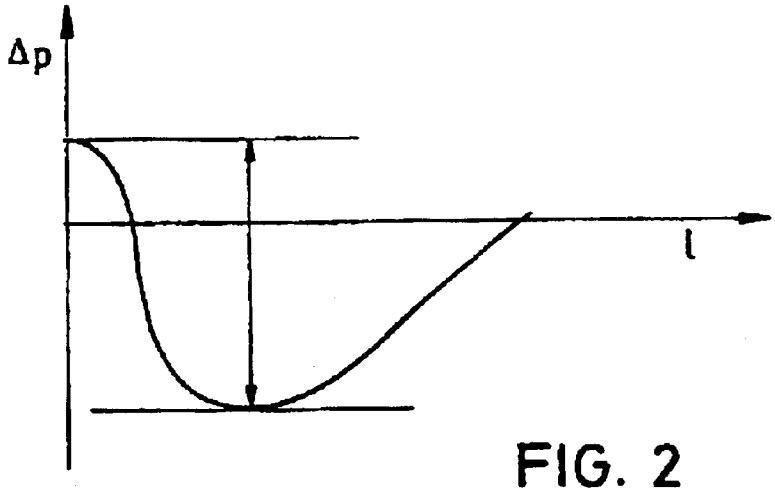
FIG. 2 shows a diagram of the axial pressure variation in the Venturi tube shown in FIG. 1.

The axial pressure characteristic in the Venturi tube 11 is shown in FIG. 2, in a diagram with the length $\epsilon$ of the Venturi tube 11 plotted on its x axis, and the pressure differential $\Delta p$ in the Venturi tube 11 plotted on its y axis. Accordingly, the combustion air at the inlet point into the inlet part 13 of the Venturi tube 11 has a low overpressure which is achieved by the fan which delivers the combustion air. With flow through the inlet part 13, due to the narrowing of the cross section the speed increases, at the same time the combustion air pressure drops, and in the transition to the subsequent diffuser part 12, reaches a minimum value. This minimum absolute pressure corresponds to a maximum underpressure compared to the combustion chamber pressure level. This underpressure decreases downstream in the continuation of the diffuser part 12 so that the combustion air entering the combustion chamber 10 is roughly at the combustion chamber pressure.

The nozzle 16 has at least one radial hole 18 which discharges into the axial fuel delivery hole of the nozzle 16. Via this radial hole 18, air is introduced into the delivery path of the liquid fuel so that in the nozzle 16 swirling of the combustion air and liquid fuel occurs. This mixture then emerges atomized from the outlet opening of the nozzle 16 and mixes in the diffuser part 12 with the combustion air which is taken in along the arrow 17 and which is provided to the inlet part 13 by the fan with low pressure.

Figure 4:
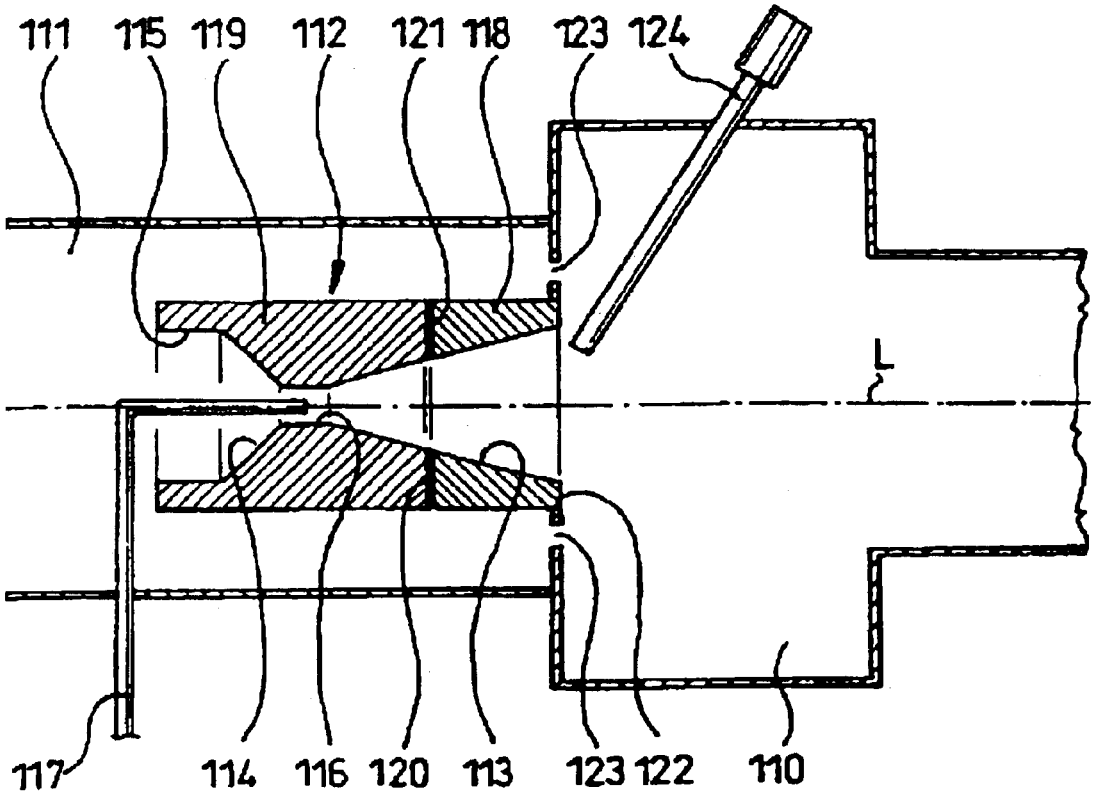
FIG. 4 shows a Venturi tube with an axial separation site in the area of the diffuser.

Moreover, preferably secondary combustion air is supplied to the combustion chamber 10. For this purpose, at the point at which the diffuser part 12 of the Venturi tube passes into the combustion chamber 10, distributed around the periphery, secondary air openings 20 are formed via which secondary air is fed into the combustion chamber 10. There can also be secondary air openings alternatively or additionally on the jacket of the combustion chamber 10. FIG. 4 schematically shows, in a lengthwise section, the rear part of the combustion chamber of a burner equipped with an embodiment of a Venturi nozzle of the invention for an auxiliary motor vehicle heater.

The cylindrical combustion chamber 110 is connected downstream of the combustion air supply chamber 111 into which combustion air is supplied by means which are not shown, typically by means of a fan. The combustion chamber 110, running coaxially to its lengthwise central axis L which is shown by the dot-dash line, has a connection opening 122 for connection of the downstream end of the Venturi nozzle 112 which is located completely within the combustion air supply chamber 111. Around this connection opening 122 is a ring of smaller openings 123 for the passage of secondary combustion air into the combustion chamber 110.

The Venturi nozzle 112, in the downstream area, comprises a conical diffuser 113 which discharges into the combustion chamber 110 and which tapers in the upstream direction. In the upstream direction, the Venturi nozzle 112 comprises a conical inlet part 114 which has a diameter variation which is opposite the diffuser 113, i.e., conically tapers in the direction toward the diffuser 113. The outside end of the inlet part 114 adjoins a cylinder part 115 which discharges into the combustion air supply chamber 111. The diffuser 113 and the inlet part 114 are connected via a cylinder part 116 which is small in diameter and into which a fuel feed tube 117 discharges. The fuel feed tube 117 runs coaxially to the lengthwise central axis of the Venturi nozzle 112 and is routed out of the combustion air supply chamber 111 at an angle outside of this nozzle.

In this arrangement of the combustion air supply chamber 111 and the Venturi nozzle 112, liquid fuel is taken into the combustion air by the underpressure which prevails in the area of the narrowest point (in the area of the cylinder part 116) and atomized. The combustion air supplied to the inlet part 114 from the combustion air supply chamber 111, together with the atomized fuel from the Venturi nozzle 112, is delivered into the combustion chamber 110. The mist of fuel and combustion air is ignited in the combustion chamber 110 and burned as it is additionally mixed with additional secondary combustion air from the openings 123. For this purpose, an ignition means 124 projects into the combustion chamber 110 and its end extends into the area of the exit of the conical diffuser 113 of the Venturi nozzle 112.

According to the invention, the Venturi nozzle 112 is axially divided into two parts, specifically into a discharge part 118 which borders the combustion chamber 10, and a supply part 119 which is located upstream of this discharge part 118. The axial division of the Venturi nozzle 112 is made in the area of its diffuser 113 so that the supply part 119 is roughly twice as long as the discharge part 18.

In the preferred embodiment shown in FIG. 4, the discharge part 118 and the supply part 119 are separated from one another by an annular gap 120 with a width which is typically between 0.1 and 0.8 mm. Preferably, the gap width is chosen to be roughly 0.3 mm. In the axial direction, the annular gap 120 is bordered by the facing annular end faces of the discharge part 118 and the feed part 119 and radially by a ring seal 121 which seals the annular gap 120 and thus the conical diffuser 113 relative to the outside. The material of the ring seal 121 is preferably a heat-insulating material such as, for example, a ceramic. The Venturi nozzle 112 is made of metal, but preferably is also at least partially made of a ceramic. The material for the two Venturi nozzle parts 118, 119 can be the same. However, preferably, the material of the discharge part 118 has a lower thermal conductivity than the material of the supply part 119 in order to transfer as little heat as possible to the annular gap 120 between the two Venturi nozzle parts 118, 119.

Due to the heat-insulated division of the Venturi nozzle 112 of the invention, it has a cold and a hot part. The upstream cold supply part 119 is typically exposed to temperatures below 180° C. in operation due to the division of the Venturi nozzle into two parts so that cracking of the fuel cannot occur in this nozzle part 119. On the other hand, the flame-side hot discharge part 118 of the Venturi nozzle 112 is typically exposed to temperatures above 500° C. so that liquid fuel striking its inside wall from the fuel feed tube 117 vaporizes without leaving crack residues. Thus, it is ensured that the Venturi nozzle 112 is not clogged with residues, and thus, its efficiency is not adversely affected.

The ring seal 121 can fill the entire annular gap 120. Alternatively, it is also conceivable for the ring seal 121 to be completely omitted. For a very narrow annular gap 120, there is almost no leakage of fuel-air mixture to the outside. Small leaks would be supplied to the combustion chamber with the secondary combustion air and burned there.

As a result of the low pollutant discharge which can be achieved with a burner equipped with the Venturi nozzle in accordance with the invention, a longer service life of the burner, and thus of the heater, and less environmnental impact are ensured. Finally, the starting behavior is optimum by the use of the Venturi nozzles according to the invention.

What is claimed is:

1. Venturi nozzle for atomization of liquid fuel for combustion of the fuel in the presence of combustion air in a combustion chamber of a burner, wherein the Venturi nozzle is axially divided into a fuel/combustion air discharge part and a fuel/combustion air supply part, and wherein the fuel/combustion air discharge part and the fuel/combustion air supply part are thermally insulated relative to one another;

wherein facing annular end faces of the discharge and supply parts of the Venturi nozzle are separated from one another at least partially via an annular gap.

2. Venturi nozzle as claimed in claim 1, wherein the supply part of the Venturi nozzle has a greater axial extension than the discharge part.

3. Venturi nozzle as claimed in claim 2, wherein the supply part of the Venturi nozzle is roughly twice as long as the discharge part.

4. Venturi nozzle as claimed in claim 1, wherein the discharge part of the Venturi nozzle is made of a material with a thermal conductivity which is poorer than that of the supply part.

5. Venturi nozzle as claimed in claim 1, wherein the annular gap is radially bordered by a ring seal.

6. Venturi nozzle as claimed in claim 1, wherein the annular gap has a gap width between 0.1 and 0.8 mm.

7. Venturi nozzle as claimed in claim 1, wherein the annular gap has a gap width of roughly 0.3 mm.

8. Venturi nozzle as claimed in claim 1, wherein the fuel/combustion air discharge and a part and a fuel/combustion air supply part are separated from each other at a diffuser part of the Venturi nozzle.

9. Venturi nozzle as claimed in claim 1, wherein at least the discharge part is made of a ceramic material.

10. Venturi nozzle for atomization of liquid fuel for combustion of the fuel in the presence of combustion air in a combustion chamber of a burner, wherein the Venturi nozzle is axially divided into a fuel/combustion air discharge part and a fuel/combustion air supply part, and wherein the fuel/combustion air discharge part and the fuel/combustion air supply part are thermally insulated relative to one another;

wherein the discharge part and the supply part are separated from one another by a ring seal which axially borders facing annular end faces of the discharge and supply parts essentially over the entire surface thereof.

11. Venturi nozzle as claimed in claim 10, wherein the ring seal is made of a thermally insulating material.

12. Venturi nozzle as claimed in claim 10, wherein the ring seal is made of a ceramic material.

13. Burner for an auxiliary motor vehicle heater, comprising:

a combustion chamber for combustion of liquid fuel in the presence of combustion air; and a mixing means which comprises a nozzle for atomization of liquid fuel, the nozzle comprising a Venturi tube or a Venturi nozzle with an inlet part which tapers in flow direction of the combustion air and with a diffuser part which widens in the flow direction of the combustion air, the diffuser part having a larger diameter end which discharges into the combustion chamber in an underpressure area in a transition area from the inlet part to the diffuser part;

wherein at least the diffuser part of the Venturi tube or Venturi nozzle is made of a ceramic material, wherein a fuel feed tube is provided for supplying fuel to the Venturi tube or Venturi nozzle, the fuel feed tube being located coaxially relative to a lengthwise center axis of the Venturi tube or Venturi nozzle and having an outlet opening located at the narrowest point between the supply Dart and the diffuser part.

14. Burner as claimed in claim 13, wherein at least the front section of the diffuser part is formed integrally with the combustion chamber.

15. Burner as claimed in claim 13, wherein the diffuser part diverges in a conical shape in toward the combustion chamber and has sections of differing opening angles.

16. Burner as claimed in claim 13, wherein the combustion chamber has at least one inlet for secondary combustion air.

17. Burner as claimed in claim 16, wherein the at least one inlet for secondary combustion air, viewed axially, is in an area of the combustion chamber in which the Venturi tube or Venturi nozzle discharges.

18. Burner as claimed in claim 13, wherein the Venturi tube or Venturi nozzle is a binary nozzle having one of a pre-atomization nozzle and a second smaller Venturi tube, an inlet and outlet opening of which is located in the Venturi tube or Venturi nozzle at a location at which a pressure drop produced by the Venturi tube or Venturi nozzle will create a flow therethrough.

19. Burner as claimed in claim 13, further comprising combustion air supply for delivering air to said inlet part.

* * * * *